US011071339B2

(12) United States Patent
Staub

(10) Patent No.: US 11,071,339 B2
(45) **Date of Patent: *Jul. 27, 2021**

(54) LOW-PROFILE EDGE POCKET

(71) Applicant: NIKE, Inc., Beaverton, OR (US)

(72) Inventor: Andrea J. Staub, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 120 days.

This patent is subject to a terminal disclaimer.

(21) Appl. No.: 16/440,277

(22) Filed: Jun. 13, 2019

(65) Prior Publication Data

US 2019/0289937 A1 Sep. 26, 2019

Related U.S. Application Data

(63) Continuation of application No. 15/382,138, filed on Dec. 16, 2016, now Pat. No. 10,362,819.

(Continued)

(51) Int. Cl.
*A41D 27/20* (2006.01)
*A41D 27/24* (2006.01)

(Continued)

(52) U.S. Cl.
CPC ..... *A41D 27/201* (2013.01); *A41B 1/08* (2013.01); *A41D 1/04* (2013.01); *A41D 1/06* (2013.01);

(Continued)

(58) Field of Classification Search
CPC .... A41D 27/201; A41D 27/204; A41D 27/24; A41D 1/04; A41D 1/06; A41D 1/00;

(Continued)

(56) References Cited

U.S. PATENT DOCUMENTS 1,787,706 A 1/1931 Stember
2,075,680 A 3/1937 Weinberg (Continued)

FOREIGN PATENT DOCUMENTS

CN 2633032 Y 8/2004
CN 2778016 Y 5/2006

(Continued)

OTHER PUBLICATIONS

Communication under Rule 71(3) dated Oct. 28, 2019 in European Patent Application No. 16823463.1, 22 pages.

(Continued)

*Primary Examiner* — Robert H Muromoto, Jr.
(74) *Attorney, Agent, or Firm* — Shook, Hardy & Bacon, L.L.P.

(57) ABSTRACT

An article having a panel secured between two layers of a trim piece and having a pocket affixed to a zipper, where a first zipper tape is affixed to the panel, and a second zipper tape is secured between the two layers of the trim piece such that the pocket is in communication with an incised opening in the panel is provided. The panel may be secured between the two layers of the trim piece at a first edge, and the incised opening may be formed proximate to the first edge such that the article comprises a pocket presented proximate to the trim piece. The present invention further comprises a method of manufacturing the article including a pocket presented proximate to the trim piece.

20 Claims, 5 Drawing Sheets

Related U.S. Application Data

(60) Provisional application No. 62/270,740, filed on Dec. 22, 2015.

(51) Int. Cl.

| | |
|---|---|
| ***A41B 1/08*** | (2006.01) |
| ***A41D 1/04*** | (2006.01) |
| ***A41D 1/06*** | (2006.01) |
| *A41D 27/00* | (2006.01) |
| *A41D 1/00* | (2018.01) |

(52) U.S. Cl.
CPC ..... *A41D 27/204* (2013.01); *A41D 27/24* (2013.01); *A41D 1/00* (2013.01); *A41D 2300/322* (2013.01)

(58) Field of Classification Search
CPC .... A41D 2300/322; A41D 27/20; A41D 1/08; A41D 27/205; A41D 13/0015; A41D 13/1254; A41D 1/002; A41D 27/02; A41D 27/04; A41B 1/08; A41B 9/14; A41B 9/007; A41B 9/02; A41F 9/00; A41F 9/02; A41F 9/025
See application file for complete search history.

(56) References Cited

U.S. PATENT DOCUMENTS

| | | | |
|---|---|---|---|
| 2,725,573 | A | 12/1955 | Kornhauser |
| 2,930,046 | A | 3/1960 | Sagner |
| 3,149,343 | A | 9/1964 | Jacobson |
| 3,320,620 | A | 5/1967 | Weidler et al. |
| 4,006,494 | A | 2/1977 | Knoppel |
| 4,356,943 | A | 11/1982 | Berman |
| 4,428,080 | A | 1/1984 | Takamatsu |
| 4,958,386 | A | 9/1990 | Louis-Jeune |
| 5,165,115 | A | 11/1992 | Stanislaw |
| 5,561,865 | A | 10/1996 | Fjelstul |
| 5,870,777 | A | 2/1999 | Hans |
| 6,006,363 | A | 12/1999 | Karlin |
| 6,041,445 | A | 3/2000 | Davitt |
| 6,148,443 | A | 11/2000 | Maastricht |
| 6,368,254 | B1 | 4/2002 | Wall |
| 6,468,254 | B2 | 10/2002 | Gupton |
| 7,058,987 | B2 | 6/2006 | Salazar |
| 7,231,672 | B2 | 6/2007 | Thomas |
| 8,028,345 | B2 | 10/2011 | Waite et al. |
| 8,555,419 | B2 | 10/2013 | Demarest et al. |
| 10,362,819 | B2 * | 7/2019 | Staub ..... A41D 27/204 |
| 2003/0126768 | A1 | 7/2003 | Hutt |
| 2003/0172433 | A1 | 9/2003 | Young |
| 2003/0196245 | A1 | 10/2003 | Schweer |
| 2004/0040070 | A1 | 3/2004 | Wong |
| 2005/0109067 | A1 | 5/2005 | Starbuck et al. |
| 2005/0252119 | A1 | 11/2005 | Funk-Danielson |
| 2006/0185056 | A1 | 8/2006 | Zwick |
| 2007/0261703 | A1 | 11/2007 | Gheneva et al. |
| 2013/0303052 | A1 | 11/2013 | Conrad |
| 2014/0005010 | A1 | 1/2014 | Kaminsky |
| 2014/0182044 | A1 | 7/2014 | Cole |
| 2015/0007379 | A1 | 1/2015 | Cockram |
| 2015/0089716 | A1 | 4/2015 | Gonzales |
| 2015/0246655 | A1 | 9/2015 | Furuniwa et al. |

FOREIGN PATENT DOCUMENTS

| | | | |
|---|---|---|---|
| CN | 201878791 | U | 6/2011 |
| CN | 201995611 | U | 10/2011 |
| CN | 202286355 | U | 7/2012 |
| CN | 204245182 | U | 4/2015 |
| DE | 8102111 | U1 | 6/1981 |
| EP | 00444587 | A1 | 1/1982 |
| GB | 438341 | A | 11/1935 |

OTHER PUBLICATIONS

"Kith Football Equipment Lookbook@KithNYC," Kith Nyc, blog.kithnyc.co, Jun. 25, 2014. http://blog.kithnyc.com/2014/06-kith-football-equipment-lookbook-kith-nyc/.

"Nike Legend 2.0 TI Poly Ladies Capri," Amazon, amazon.com http://www.amazon.com/NIKE-Legend-Poly-Ladies-Capri/dp/B00FOH4OIS.

"Adidas Black Slim/Tapered Leg Track Pant M Warmup Medium Zippered Running Stretc," eBay, ebay.com, Seller: doglover9920. http://www.ebay.com/itm/Adidas-Black-Slim-Tapered-Leg-Track-Pant-M-Warmup-Medium-Zippered-Running-Stretc-/121592154306.

* cited by examiner

LOW-PROFILE EDGE POCKET

CROSS-REFERENCE TO RELATED APPLICATIONS

This application, assigned U.S. application Ser. No. 16/440,277, filed on Jun. 13, 2019, and entitled "Low-Profile Edge Pocket," is a continuation application of U.S. application Ser. No. 15/382,138, filed Dec. 16, 2016, and entitled "Low-Profile Edge Pocket." The '138 application claims priority to U.S. Provisional App. No. 62/270,740, filed Dec. 22, 2015, entitled "Low-Profile Edge Pocket." The entireties of the aforementioned applications are incorporated by reference herein.

FIELD

The present invention relates to advanced garments and apparel having one or more edge pockets.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, aspects herein are directed to an article of apparel formed from at least one panel of material, a trim piece formed from at least two layers, and a pocket having a zipper, where the zipper comprises at least a set of zipper teeth interposed between a first zipper tape and a second zipper tape. In exemplary aspects, the trim piece is affixed to a first edge of the panel. In exemplary aspects, a low-profile edge pocket is formed by affixing the first zipper tape to the panel and affixing the second zipper tape between the two layers of the trim piece such that the zippered opening is in communication with an incision in the panel. Thus, by positioning the second zipper tape within the trim piece—as opposed to securing the second zipper tape to the panel alone as is traditionally done, the zippered opening to the pocket may be positioned directly adjacent to an edge of the trim piece thus creating a low-profile pocket.

In some aspects of the present invention, the panel may form in part a lower body garment having a pelvic portion, a right leg portion, and a left leg portion. In these aspects, the trim piece may comprise a waistband portion. The pelvic portion is adapted to cover a pelvic area of a wearer when the article is in an as-worn position. The pelvic portion has a waist opening and the right and left leg portions extend downward from the pelvic portion opposite the waist opening. The right and left leg portions have respective right and left leg openings. The right and left leg portions are adapted to cover at least a portion of respective right and left legs of the wearer when the article is in the as-worn position.

In other aspects, the article may comprise an upper body garment having a torso portion. In some aspects, the upper body garment may have right and left arm portions extending distally from the torso portion. In aspects, the trim piece may comprise a collar portion, a waistband portion, or a cuff portion.

Another aspect of the present invention is directed to a method of manufacturing an article having a low-profile edge pocket located proximate to a trim piece. The method may comprise the step of providing a trim piece having a first layer and a second layer and providing a panel having at least a first edge. Continuing, the method may comprise the step of forming an incision in the panel proximate to the first edge. A pocket may be provided where the pocket has a pocket opening secured by a zipper, wherein the zipper has a set of zipper teeth interposed between a first zipper tape and a second zipper tape. The method may further comprise the step of affixing the first zipper tape to the panel proximate to the incision, such that the pocket opening is in communication with the incision. The second zipper tape may then be affixed between the first and second layers of the trim piece. In some aspects, the method may further comprise the step of affixing a pocket edge to the panel.

Another aspect of the present invention is directed to an article of pants having one or more low-profile edge pockets. The pants may have a panel comprising a pelvic portion, a right leg portion, and a left leg portion. The pelvic portion is adapted to cover a pelvic area of a wearer when the pants are in the as-worn position and includes a waist opening. The right and left leg portions extend away from the pelvic portion opposite the waist opening. The left and right leg portions are adapted to cover at least a portion of respective left and right legs of a wearer when the pants are in the as-worn position. The panel may further comprise a first edge associated with the waist opening and an incised opening proximate to the first edge. The pants may also have a waistband portion associated with the waist opening of the panel. The waistband portion comprises a first layer and a second layer, in accordance with some aspects. The first edge of the panel is secured between the first layer and the second layer of the waistband portion. The pants may also have a pocket with a zippered opening, where the zipper comprises a set of zipper teeth interposed between a first zipper tape and a second zipper tape. The first zipper tape may be affixed to the panel proximate to the incised opening and the second zipper tape may be affixed between the first layer and the second layer of the waistband portion, such that the zippered opening is in communication with the incised opening of the panel. The pocket, in turn, may further comprise a first pocket panel affixed to a second pocket panel to present a pocket container or pouch. In some aspects, at least the first pocket panel may be affixed to the panel.

BRIEF DESCRIPTION OF THE DRAWINGS

Examples of the present invention are described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Throughout this description, the term "as-worn position" will be used when discussing the orientation of the disclosed article of apparel. The as-worn position of the article of apparel denotes the position the article of apparel is in when donned by a wearer. Hence, in the as-worn position, an upper-body garment, such as a shirt, will be oriented such that a neck opening will be at the top of the shirt and near the upper end of the wearer's torso. Similarly, in the as-worn position, a lower-body garment, such as a pair of pants, will be oriented such that a waist opening will be at the top of the pants and near the waist of the wearer.

Figure 1:
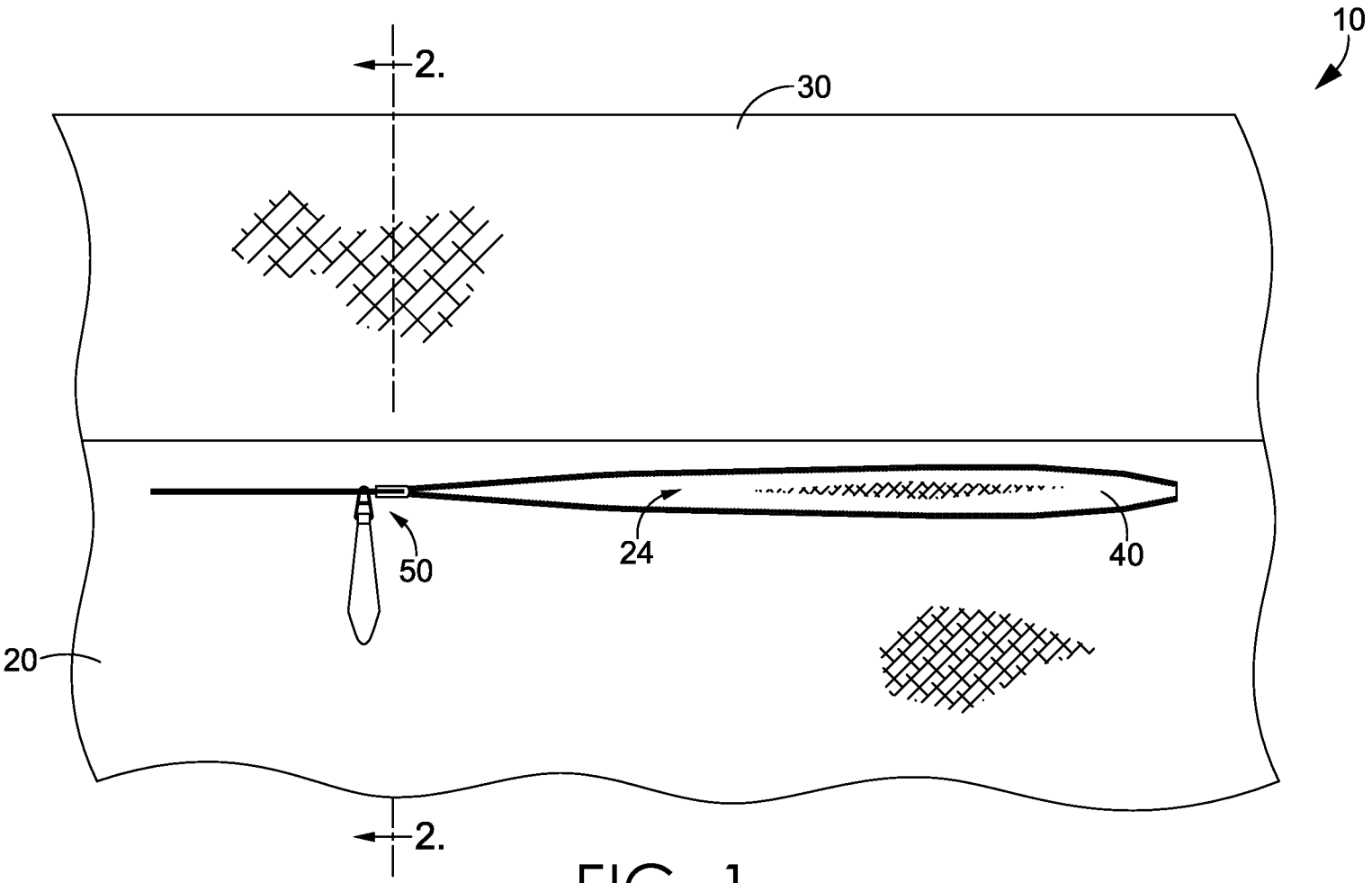
FIG. 1 illustrates a front elevation view of a section of an exemplary article of apparel having an edge pocket in accordance with an aspect described herein.
Figure 2A:
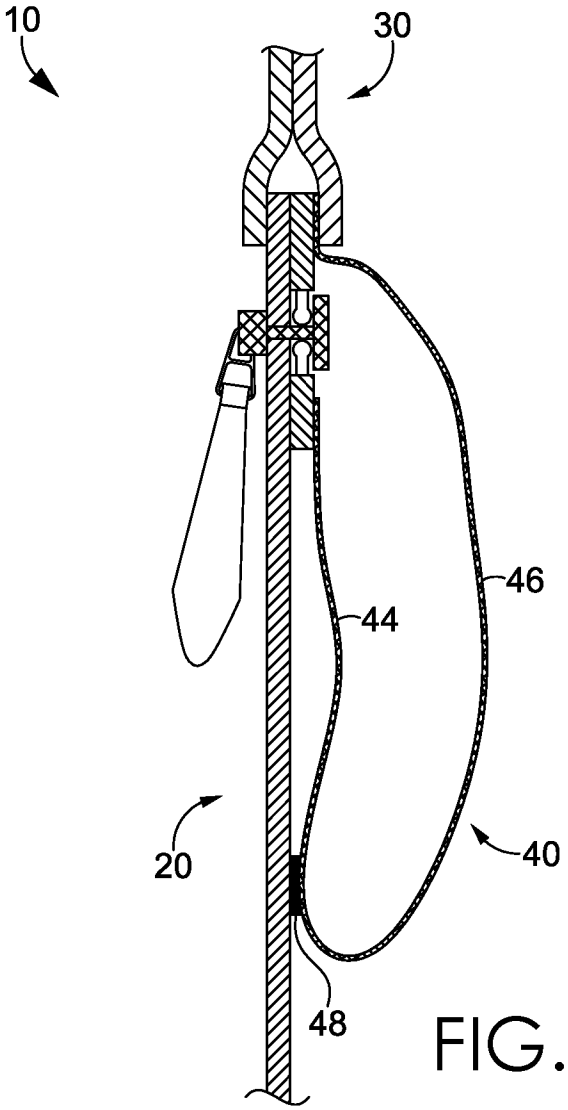
FIG. 2A illustrates another cross-sectional view similar to that of FIG. 2 and depicts a pocket affixed to a panel in accordance with an aspect described herein.
Figure 2:
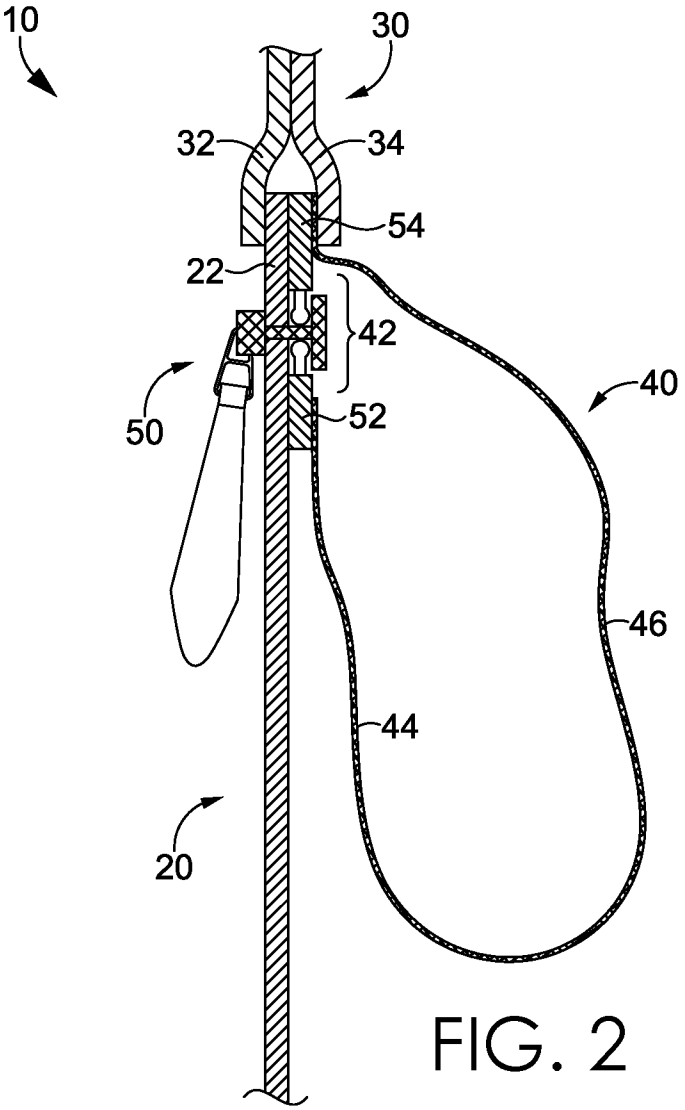
FIG. 2 illustrates a cross-sectional view taken along cut line 2-2 of FIG. 1 and depicts an exemplary article in accordance with an aspect described herein.

At a high level, the present invention provides an article of apparel having a low-profile edge pocket positioned proximate to a trim piece. Referring initially to FIGS. 1 and 2, one aspect of the present invention is directed to an article 10 (a portion of which is shown) having a panel 20 with a first edge 22 secured between two layers of a trim piece 30. The panel 20 further includes an incised opening 24. As used throughout this disclosure, the terms "securing" or "affixing" mean either releasably or permanently attaching objects together using affixing technologies such as stitching, bonding, welding, hook-and-loop fasteners, buttons, snaps, and the like. The panel 20 may be comprised of a knit fabric, a woven fabric, or any other suitable material.

The trim piece 30 has a first layer 32 and a second layer 34. In some aspects, the first layer 32 and the second layer 34 comprise a unitary panel folded over to present two layers. In other aspects, the first layer 32 and the second layer 34 are separate panels affixed to one another. The trim piece 30 may be formed of the same material as the panel 20, or the trim piece 30 may be formed of a different material as the panel 20. In one aspect, the panel 20 is secured between the first layer 32 and the second layer 34 of the trim piece 30 via the first edge 22 of the panel 20. The incised opening 24 may be formed proximate to the first edge 22 and permits communication through the panel 20. In the illustrated aspect, the incised opening 24 is proximate to the trim piece 30. In some aspects, the incised opening 24 may be formed in the panel 20 between 3 and 10 millimeters from an edge of the trim piece 30.

The article 10 also comprises a pocket 40 to which a zipper 50 may be affixed. The zipper 50 comprises a set of zipper teeth interposed between a first zipper tape 52 and a second zipper tape 54. The pocket 40 comprises a pocket opening 42 that is in communication with the incised opening 24. In some aspects, the zipper 50 may allow and/or disallow communication through the incised opening 24 and into the pocket 40. At least one edge of the pocket 40 is affixed to the first zipper tape 52 and a second edge of the pocket 40 is affixed to the second zipper tape 54. The first zipper tape 52, in turn, is affixed to the panel 20 proximate the incised opening 24. The second zipper tape 54 is secured between the first layer 32 and the second layer 34 of the trim piece 30.

In some aspects, the second zipper tape 54 may be entirely enclosed by the first layer 32 and the second layer 34 of the trim piece 30 such that only the zipper teeth are directly adjacent to the trim piece 30. In other aspects, the second zipper tape 54 may only be partially enclosed by the first layer 32 and the second layer 34 of the trim piece 30. In one aspect, the second zipper tape 54 may be affixed to the panel 20 at the first edge 22, such that the first edge of the panel 20 and the second zipper tape 54 present a unitary portion enclosed by the first layer 32 and the second layer 34 of the trim piece 30. In another aspect, the second zipper tape 54 is not affixed to the panel 20 and the two are interposed between the first layer 32 and the second layer 34 of the trim piece 30. Positioning the zippered opening directly adjacent to the bottom edge of the trim piece 30 creates a low-profile, or hidden, edge pocket that may interfere less with the wearer's movement or activities (for example, a wearer engaging in sit-up exercises).

With respect to the pocket 40, the pocket 40, in one aspect, may comprise a first pocket panel 44 affixed to a second pocket panel 46. In another aspect, the first pocket panel 44 may represent a contiguous extension of the second pocket panel 46. In either case, the first pocket panel 44 and the second pocket panel 46 present the pocket opening 42. In one aspect, the first pocket panel 44 may be affixed to the first zipper tape 52. In another aspect, the second pocket panel 46 may be affixed to the second zipper tape 54. In some aspects, the pocket 40 is only affixed via the two zipper tapes 52 and 54. Referring to FIG. 2A, in exemplary aspects, the pocket 40 may be further affixed to the panel 20. For instance, the first pocket panel 44 may be affixed to the panel 20 with adhesive tape 48 or by some other affixing technology as described herein. In other aspects, the pocket 40 may be affixed to the panel 20 along its entire perimeter.

Figure 4:
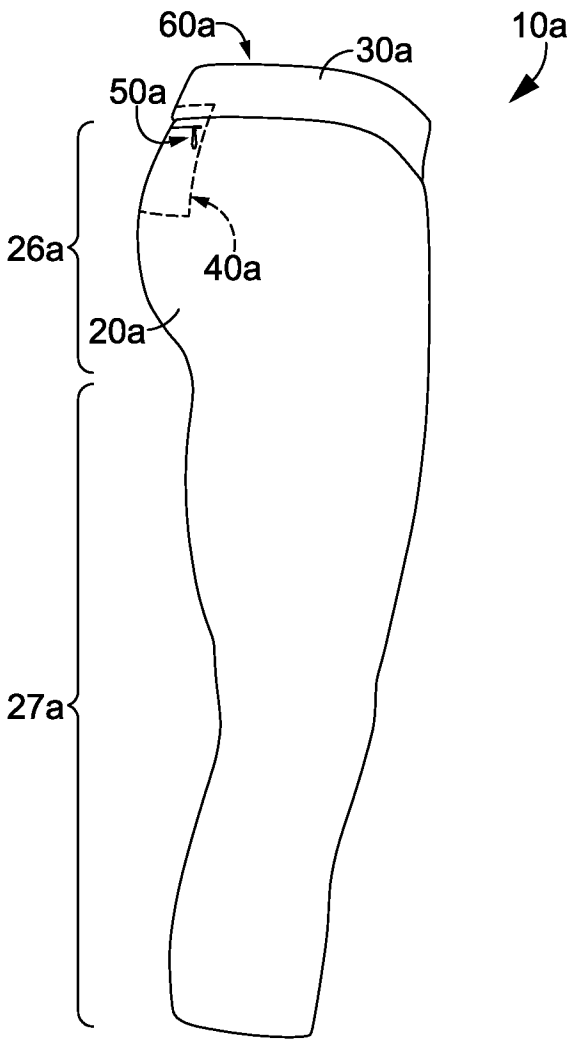
FIG. 4 illustrates a side elevation view of a lower-body garment in accordance with an aspect described herein.
Figure 3:
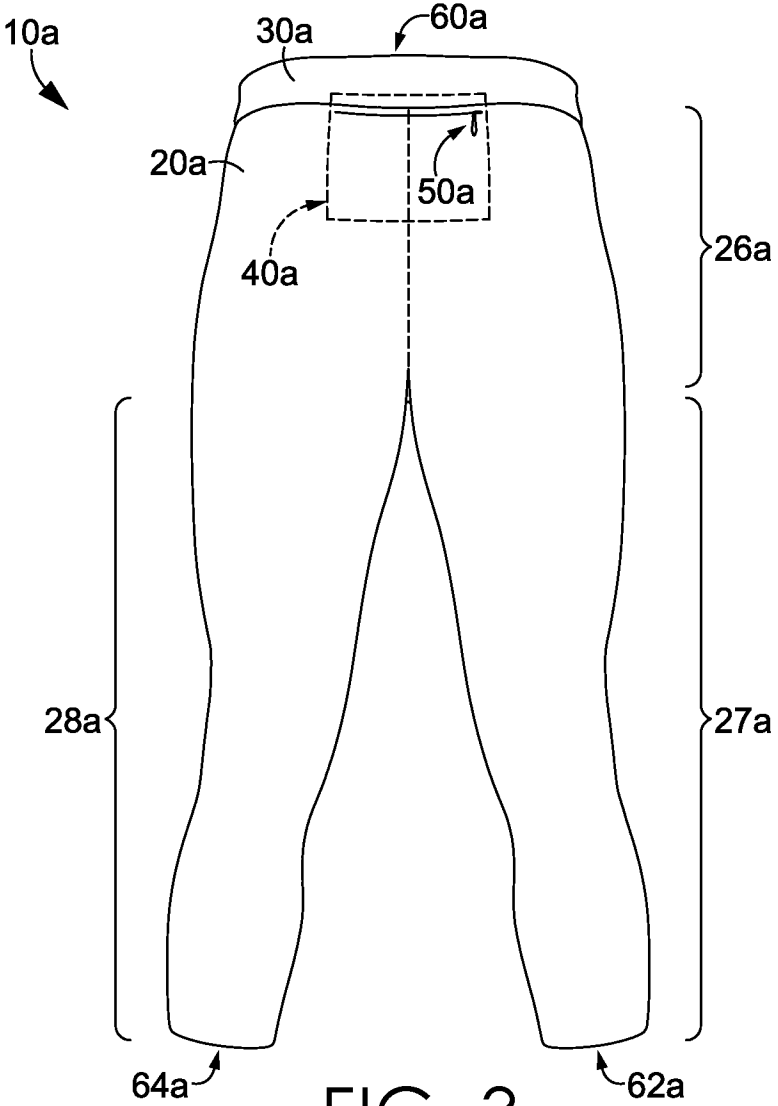
FIG. 3 illustrates a rear elevation view of a lower-body garment in accordance with an aspect described herein.

FIGS. 3 and 4 depict another aspect of the present invention wherein the article 10 comprises a lower-body garment 10*a*. The lower-body garment 10*a* comprises at least a panel 20*a* having a pelvic portion 26*a*, a right leg portion 27*a*, and a left leg portion 28*a*. The trim piece 30 of the lower-body garment 10*a* may be a waistband 30*a*. In one aspect, the pelvic portion 26*a* comprises a waist opening 60*a*. The right and left leg portions 27*a* and 28*a* each extend from the pelvic portion 26*a* opposite the waist opening 60*a* to a right leg opening 62*a* and left leg opening 64*a*, respectively. In some aspects, an upper or first edge of the panel 20*a* is affixed between the two layers of the waistband 30*a*. The incised opening (shown as closed in FIG. 3) in the lower-body garment 10*a* is formed in the pelvic portion 26*a* proximate to the waistband 30*a* on a back-facing side of the garment 10*a*. The illustrated pocket 40*a* of the lower-body garment 10*a* is depicted having the zipper 50*a* closed and thereby disallowing communication through the incised opening. It is contemplated herein that the incised opening of the pocket 40*a* could be positioned anywhere along the circumference of the waistband 30*a*. It is further envisioned that a plurality of pockets 40*a* could be formed and affixed to the lower-body garment 10*a* as described herein. In some aspects, the lower-body garment 10*a* may comprise pants, tights, capris, shorts, and other types of lower-body garments.

Figure 5:
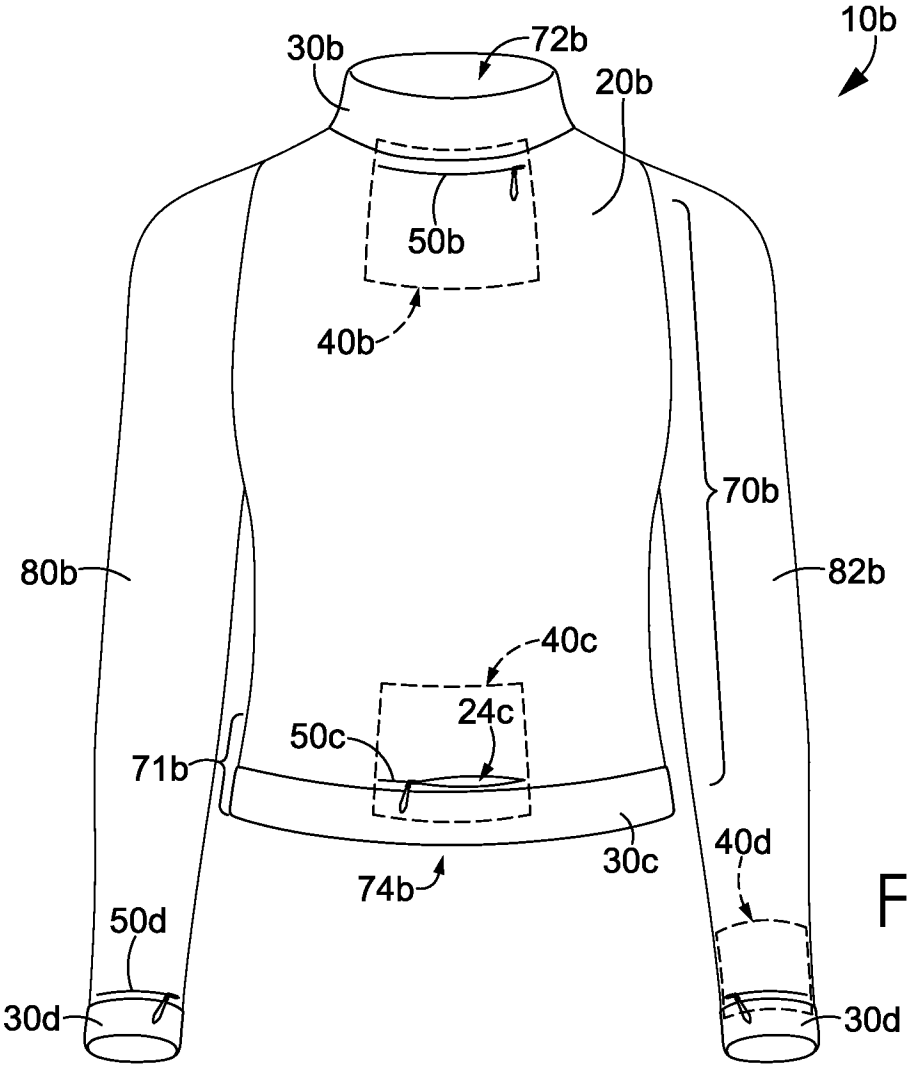
FIG. 5 illustrates a front elevation view of an upper-body garment in accordance with an aspect described herein.

Turning to FIG. 5, another aspect of the present invention wherein the article 10 comprises an upper-body garment 10*b* is provided. The upper-body garment 10*b* may comprise a panel 20*b* having a torso portion 70*b*. The torso portion 70*b* may present a neck opening 72*b* at its top, a waist opening 74*b* at its bottom, and right and left arm openings (not shown) along its medial portion, when the upper-body garment 10*b* is in the as-worn position. In some aspects, a right arm portion 80*b* and/or a left arm portion 82*b* extend away from the torso portion 70*b* and are adapted to cover at least a portion of a wearer's right and left arms, respectively, when the upper-body garment 10*b* is in the as-worn position. In some aspects, the trim piece 30 of the upper-body garment 10*b* may be a collar 30*b* that is associated with the neck opening 72*b*. In other aspects, the trim piece 30 of the upper-body garment may be a waistband 30*c* that is positioned at a lower margin 7 lb of the torso portion 70*b* and associated with the waist opening 74*b*. In yet other aspects, the trim piece 30 of the upper-body garment 10*b* may be one or more cuffs 30*d* that are associated with at least one of the right or left arm openings. In some aspects, a first edge (not shown) of the panel 20*b* is associated with the top of the torso portion 70*b* (when the article is in the as-worn position) and is affixed between the two layers of the collar 30*b*. In other aspects, a first edge (not shown) of the panel 20*b* may be associated with the bottom of the torso portion 70*b* (or associated with the end of at least one of the arm portions 80*b* or 82*b*), when the article is in the as-worn position, and is affixed between the two layers of the waistband 30*c* (or the cuff 30*d*).

An incised opening 24*b* in the upper-body garment 10*b* may be formed in the top of the torso portion 70*b* proximate to the collar 30*b*, in the bottom of the torso portion 70*b* proximate to the waistband 30*c*, or in the end of at least one of the arm portions 80*b* or 82*b* proximate to the one or more cuffs 30*d*. The illustrated pocket 40*b* of the upper-body garment 10*b* is depicted having a zipper 50*b* closed and thereby disallowing communication through the incised opening. The illustrated pocket 40*c* of the upper-body garment 10*b* is depicted having a zipper 50*c* partially open and thereby allowing communication through an incised opening 24*c*. The illustrated pocket 40*d* of the upper-body garment 10*b* is depicted having a zipper 50*d* closed.

In the illustrated aspect, the pocket 40*b* is shown centered on the front side of the upper-body garment 10*b* about the neck opening 72*b*. It is envisioned that the pocket 40*b* could be positioned anywhere along the circumference of the panel 20*b* and collar 30*b*. Likewise, it is envisioned that the pocket 40*c* could be positioned anywhere along the circumference of the panel 20*b* and waistband 30*c*. Similarly, it is envisioned that the pocket 40*d* could be positioned anywhere along the circumference of the panel 20*b* of either arm portion 80*b* or 82*b* and cuff 30*d*.

It is further envisioned that a plurality of pockets 40*b* (or 40*c* or 40*d*) could be formed and affixed to the upper-body garment 10*b*. In some aspects, the upper-body garment 10*b* may comprise a vest, a t-shirt, a long-sleeved shirt, a sleeveless shirt, and other types of upper-body garments.

Figure 6:
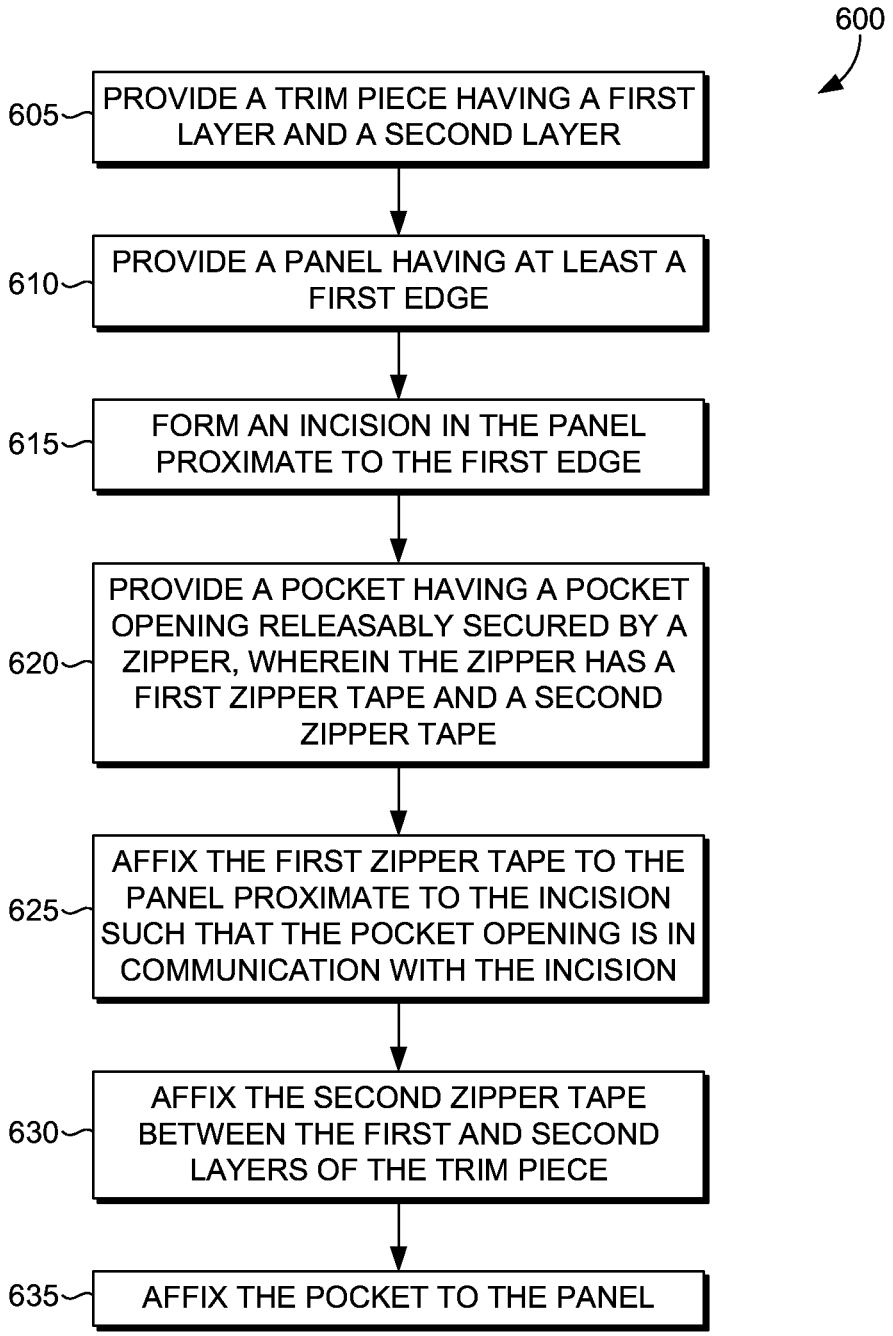
FIG. 6 depicts a flow diagram illustrating an exemplary method of manufacturing an article of apparel in accordance with an aspect described herein.

Turning now to FIG. 6, another aspect of the present invention is directed to a method 600 of manufacturing an article (such as the article 10 of FIG. 1) having a pocket in communication through an incised opening in a panel and positioned proximate to a trim piece. The method 600 may comprise the step of providing the trim piece having a first layer and a second layer, as depicted in block 605. In aspects, the first layer and the second layer may comprise contiguous extensions of each other, or they may comprise separate panels. The method 600 may further comprise the step of providing the panel that has at least a first edge, as depicted in block 610. The method 600 may further comprise the step of forming an incised opening in the panel proximate to the first edge, as depicted in block 615. The method 600 may further comprise the step of providing a pocket having a pocket opening releasably secured by a zipper, wherein the zipper has a set of zipper teeth secured between a first zipper tape and a second zipper tape as depicted in block 620. The method 600 may further comprise the step of affixing the first zipper tape to the panel proximate to the incision such that the pocket opening is in communication with the incised opening, as depicted in block 625. The method 600 may further comprise the step of affixing the second zipper tape between the first and second layers of the trim piece, as depicted in block 630. The method 600 may further comprise the step of affixing the pocket to the panel, as depicted in block 635.

It is envisioned that the concept of an edge pocket located proximate to a trim piece may be applied to articles other than articles of apparel (for example, a duffle bag, an attaché, a golf bag, etc.) so long as such other articles have a panel and a trim piece.

It is also envisioned that the zipper 50 may be replaced with alternate forms of closures. For example, hook and loop tape may be used where the hook portion of the tape may replace either the first zipper tape 52 or the second zipper tape 54 and the loop portion of the tape may replace the other. It is understood that any closure having two opposing tapes may be substituted for the zipper 50.

From the foregoing, it will be seen that aspects described herein are well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible aspects described herein may be made without departing from the scope thereof, it is to be understood that all matter herein set forth or shown in the accompanying drawings is to be interpreted as illustrative and not in a limiting sense.

The invention claimed is:

1. An article comprising:

a trim piece having a first layer, a second layer, and a first trim piece edge;

a panel comprising a first panel edge, the panel having an incised opening proximate to the first panel edge, wherein the first panel edge is secured between the first layer and the second layer of the trim piece; and a pocket having a pocket opening in communication with the incised opening of the panel, the pocket opening positioned adjacent to the first trim piece edge and releasably secured by a zipper comprising at least a first zipper tape and a second zipper tape, the first zipper tape affixed to the panel and the second zipper tape affixed between the first layer and the second layer of the trim piece.

2. The article of claim 1, wherein the article comprises a lower-body garment.

3. The article of claim 2, wherein the trim piece comprises a waistband portion of the lower-body garment.

4. The article of claim 3, wherein the pocket is centered on a rearward side of the lower-body garment.

5. The article of claim 1, wherein the article comprises an upper-body garment.

6. The article of claim 5, wherein the trim piece comprises a collar portion of the upper-body garment.

7. The article of claim 5, wherein the trim piece comprises a waistband portion affixed to a lower margin of a torso portion of the upper-body garment.

8. The article of claim 5, wherein the trim piece comprises a cuff portion affixed to one or more of a right sleeve and a left sleeve of upper-body garment.

9. The article of claim 1, wherein the pocket comprises at least a first pocket panel and a second pocket panel affixed to the first pocket panel, and wherein at least the first pocket panel is affixed to the panel.

10. The article of claim 9, wherein the first pocket panel is affixed to the panel by adhesive tape.

11. The article of claim 9, wherein the first pocket panel is affixed to the panel along its perimeter edge.

12. The article of claim 1, wherein the pocket is positioned interior to the panel when the article is in an as-worn position.

13. The article of claim 1, wherein the panel comprises at least one of:

a woven fabric; or a knit fabric.

14. A method of manufacturing an article comprising the steps of:

positioning a first panel edge of a panel between a first layer and a second layer of a trim piece;

forming an incision in the panel proximate to a first trim piece edge of the trim piece;

forming a pocket having a pocket opening, wherein the pocket opening is releasably secured by a zipper having a first zipper tape and a second zipper tape;

affixing the first zipper tape to the panel proximate to the incision such that the pocket opening is in communication with the incision; and affixing the second zipper tape between the first layer and the second layer of the trim piece.

15. The method of manufacturing the article of claim 14, further comprising, securing the first panel edge of the panel to one or more of the first layer and the second layer of the trim piece.

16. The method of manufacturing the article of claim 15, wherein the article comprises a lower-body garment.

17. The method of manufacturing the article of claim 16, wherein the trim piece comprises a waistband portion of the lower-body garment.

18. The method of manufacturing the article of claim 15, wherein the article comprises an upper-body garment.

19. The method of manufacturing the article of claim 18, wherein the trim piece comprises one or more of a collar portion, a cuff portion, and a waistband portion of the upper-body garment.

20. An article comprising:

a trim piece having at least a first layer and a first trim piece edge;

a panel comprising a first panel edge, the panel having an incised opening proximate to the first panel edge, wherein the first panel edge is secured to the first layer of the trim piece; and a pocket having a pocket opening in communication with the incised opening of the panel, the pocket opening positioned adjacent to the first trim piece edge of the trim piece, the pocket opening releasably secured by a zipper comprising at least a first zipper tape and a second zipper tape, the first zipper tape affixed to the panel and the second zipper tape affixed to the first layer of the trim piece.

* * * * *